US009466236B2

(12) United States Patent
Small

(10) Patent No.: US 9,466,236 B2
(45) Date of Patent: Oct. 11, 2016

(54) DITHERING TO AVOID PIXEL VALUE CONVERSION ERRORS

(71) Applicant: Synaptics Incorporated, San Jose, CA (US)

(72) Inventor: Jeffrey A. Small, Rochester, NY (US)

(73) Assignee: SYNAPTICS INCORPORATED, San Jose, CA (US)

( * ) Notice: Subject to any disclaimer, the term of this patent is extended or adjusted under 35 U.S.C. 154(b) by 263 days.

(21) Appl. No.: 14/017,290

(22) Filed: Sep. 3, 2013

(65) Prior Publication Data

US 2015/0062150 A1 Mar. 5, 2015

(51) Int. Cl.
*G09G 5/02* (2006.01)
*G09G 3/20* (2006.01)

(52) U.S. Cl.
CPC ..... *G09G 3/2011* (2013.01); *G09G 3/2044* (2013.01); *G09G 3/2077* (2013.01); *G09G 2320/0276* (2013.01)

(58) Field of Classification Search
CPC ..... G09G 5/02; G09G 3/204; G09G 3/2011; G09G 3/2077; G09G 3/2044; G09G 2320/0276
See application file for complete search history.

(56) References Cited

U.S. PATENT DOCUMENTS

| | | | | |
|---|---|---|---|---|
| 5,835,117 | A | 11/1998 | Small | |
| 6,900,816 | B1 * | 5/2005 | Kawamura | 345/619 |
| 2006/0221401 | A1 * | 10/2006 | Daly et al. | 358/3.13 |
| 2007/0024636 | A1 * | 2/2007 | Lo | 345/596 |
| 2008/0001975 | A1 * | 1/2008 | Obara | G06T 5/20 345/694 |
| 2008/0252655 | A1 * | 10/2008 | Raghuram et al. | 345/596 |
| 2009/0284546 | A1 | 11/2009 | Brown | |
| 2011/0025591 | A1 | 2/2011 | Han et al. | |
| 2011/0074850 | A1 * | 3/2011 | Walmsley et al. | 347/12 |
| 2013/0279789 | A1 * | 10/2013 | Elter et al. | 382/134 |

* cited by examiner

*Primary Examiner* — James A Thompson
*Assistant Examiner* — Tapas Mazumder
(74) *Attorney, Agent, or Firm* — Patterson + Sheridan, LLP

(57) ABSTRACT

Embodiments of the present invention generally provide a method for processing an image. The method includes receiving a plurality of input pixel values associated with a video frame and determining that a first portion of pixel values included in the plurality of input pixel values is within a first set of excluded values. The method further includes dithering the first portion of pixel values to generate a first plurality of dithered values. Each dithered value included in the first plurality of dithered values is not within the first set of excluded values. Additionally, a first average pixel value associated with the plurality of input pixel values is substantially similar to a second average pixel value associated with both the first plurality of dithered values and a plurality of pixel values that are spatially proximate to the first plurality of dithered values.

13 Claims, 7 Drawing Sheets

DITHERING TO AVOID PIXEL VALUE CONVERSION ERRORS

BACKGROUND OF THE INVENTION

1. Field of the Invention

Embodiments of the present invention generally relate to a system, device, and method for dithering to avoid gamma curve errors.

2. Description of the Related Art

Display devices are widely used in a variety of electronic systems to provide visual information to a user. For example, display devices may be used to provide a visual interface to an electronic system, such as a desktop computer. Advancements in display technologies have enabled display devices to be incorporated into an increasing number of applications, such as laptop computers, tablet computers, and mobile phones. In such applications, display devices are capable of providing high-resolution interfaces having high contrast ratios and relatively accurate color reproduction.

Display devices are capable of reproducing a wide range of color values within a given color space. For example, conventional displays using a red, green, and blue (RGB) sub-pixel arrangement typically represent each color channel using 8 bits per pixel, or 256 discrete levels per color channel per pixel. Thus, each RGB pixel can represent approximately 16.7 million discrete color values.

Prior to display, each color value is provided to a display processor, which performs digital-to-analog conversion (DAC) and outputs the appropriate analog values (e.g., voltages, currents, etc.) for each sub-pixel of the display. The proper analog value(s) needed to accurately reproduce a particular color value depends on various characteristics of the display. For example, in some liquid crystal display (LCD) technologies, the transmissivity of a liquid crystal increases with applied voltage, as shown in FIG. 1. Thus, in such LCD displays, to increase the brightness of a particular pixel or sub-pixel, the voltage applied to the liquid crystal must be increased.

In general, the analog values required to accurately reproduce each incoming color value—at a given gamma value—may be approximated using a piecewise linear approximation. For example, with reference to FIG. 1, the curve that maps incoming color values to the voltages required to accurately reproduce the color values may be approximated using a series of straight lines. However, due to various display characteristics (e.g., material properties, manufacturing variations, device temperature, device age, and the like), the curve that maps incoming color values to their corresponding analog values may include one or more perturbations or bumps that cannot accurately be approximated using a reasonable number of straight lines. Accordingly, approximating such perturbations using one or more straight lines may cause the display processor to output voltages that are too high or too low to accurately reproduce a particular color value, resulting in an image that is too bright or too dark and/or producing color bands at color values associated with the perturbations.

Therefore, there is a need in the art for a technique for avoiding pixel value conversion errors in a display device.

SUMMARY OF THE INVENTION

Embodiments of the present invention generally provide a method for processing an image. The method includes receiving a plurality of input pixel values associated with a video frame and determining that a first portion of pixel values included in the plurality of input pixel values is within a first set of excluded values. The method further includes dithering the first portion of pixel values to generate a first plurality of dithered values. Each dithered value included in the first plurality of dithered values is not within the first set of excluded values. Additionally, a first average pixel value associated with the plurality of input pixel values is substantially similar to a second average pixel value associated with both the first plurality of dithered values and a plurality of pixel values that are spatially proximate to the first plurality of dithered values.

Embodiments of the present invention may also provide a processing system for a display device. The processing system includes a display circuit configured to receive a plurality of input pixel values associated with a video frame and determine that a first portion of pixel values included in the plurality of input pixel values is within a first set of excluded values. The processing system further includes a dithering circuit configured to dither the first portion of pixel values to generate a first plurality of dithered values. Each dithered value included in the first plurality of dithered values is not within the first set of excluded values. A first average pixel value associated with the plurality of input pixel values is substantially similar to a second average pixel value associated with both the first plurality of dithered values and a plurality of pixel values that are spatially proximate to the first plurality of dithered values.

Embodiments of the present invention may also provide an electronic device. The electronic device includes a display device and a processing system coupled to the display device. The processing system is configured to receive a plurality of input pixel values associated with a video frame and determine that a first portion of pixel values included in the plurality of input pixel values is within a first set of excluded values. The processing system is further configured to dither the first portion of pixel values to generate a first plurality of dithered values. Each dithered value included in the first plurality of dithered values is not within the first set of excluded values. A first average pixel value associated with the plurality of input pixel values is substantially similar to a second average pixel value associated with both the first plurality of dithered values and a plurality of pixel values that are spatially proximate to the first plurality of dithered values.

BRIEF DESCRIPTION OF THE DRAWINGS

So that the manner in which the above recited features can be understood in detail, a more particular description, briefly summarized above, may be had by reference to embodiments, some of which are illustrated in the appended drawings. It is to be noted, however, that the appended drawings illustrate only embodiments of the invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Various embodiments of the present invention generally provide a technique for modifying pixel values associated with a video frame to avoid conversion errors, such as digital-to-analog (DAC) conversion errors. As the term is used herein, a "pixel value" may refer to a value (e.g., gray level, luminance, transmissivity, voltage, current, charge, and the like) associated with a pixel and/or sub-pixel. A pixel value mapping is analyzed to determine a set of excluded values associated with one or more conversion errors. Input pixel values are then processed to determine which pixel values are within the set of excluded values. Dithering may be applied to these pixel values and, in some embodiments, to pixel values that are spatially proximate to these pixel values such that the resulting dithered values that are not within the set of excluded values. Advantageously, modifying pixel values to avoid conversion errors may reduce banding and other abrupt variations in brightness while maintaining similar average pixel values, thereby enhancing the quality of the displayed image.

Figure 2:
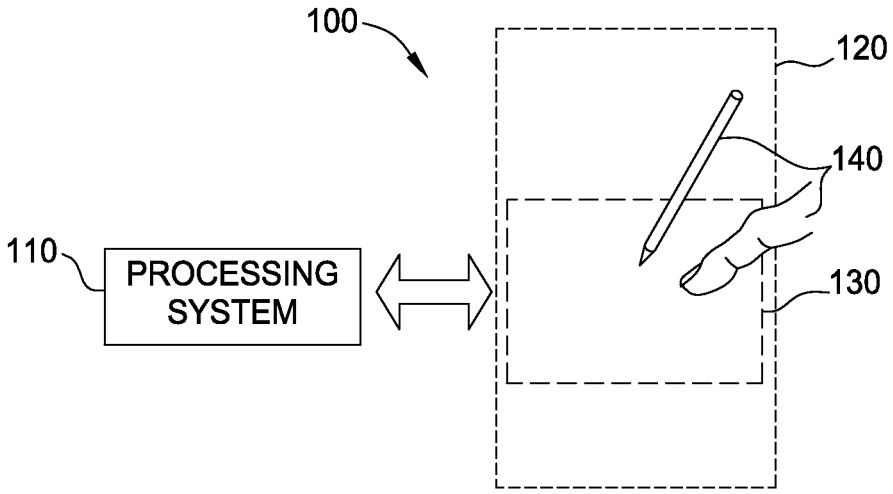
FIG. 2 is a block diagram of an exemplary display device in accordance with embodiments of the invention.

Turning now to the figures, FIG. 2 is a block diagram of an exemplary display device 100 in accordance with embodiments of the invention. The display device 100 comprises a display region 120 configured to display images to a user and an optional input sensing region 130 configured to detect user input. Example input objects 140 include fingers and styli, as shown in FIG. 2. The display region 120 and the input sensing region 130 may share physical elements. For example, some embodiments may utilize some of the same electrical components for displaying and sensing. In some embodiments, the display device 100 comprises a touch screen display interface, and the input sensing region 130 overlaps at least part of an active area of a display region 120. The input sensing region 130 may comprise substantially transparent sensor electrodes overlaying the display screen and provide a touch screen interface.

A processing system 110 may be included as part of the display device 100. The processing system 110 is configured to operate the hardware of the display device 100 to process display images (e.g., video frames) and drive display signals to display elements, such as pixels/sub-pixels disposed in the display region 120. The processing system 110 comprises parts of, or all of, one or more integrated circuits (ICs) and/or other circuitry components. For example, the processing system 110 may include a display driver (DDI) comprising display circuitry for driving display signals to refresh sub-pixels in the display region 120. In some embodiments, the processing system 110 also comprises electronically-readable instructions, such as firmware code, software code, and the like. In some embodiments, components of the processing system 110 are disposed in and/or integrated with the display region 120, such as on display substrates of the display device 100. In other embodiments, components of processing system 110 are physically separate from components in the display region 120. For example, the display device 100 may be coupled to a desktop computer, and the processing system 110 may include software configured to run on a central processing unit of the desktop computer and one or more ICs (perhaps with associated firmware) separate from the central processing unit. As another example, the display device 100 may be physically integrated in a mobile device, such as a smartphone or tablet, and the processing system 110 may comprise circuits and firmware that are part of a main processor of the mobile device. In some embodiments, the processing system 110 is dedicated to operating the display device 100. In other embodiments, the processing system 110 also performs other functions, such as sensing input devices 140, driving haptic actuators, etc.

The processing system 110 may be implemented as a set of modules that handle different functions of the processing system 110. Each module may comprise circuitry that is a part of the processing system 110, firmware, software, or a combination thereof. In various embodiments, different combinations of modules may be used. Example modules include hardware operation modules for operating hardware such as display screens and sensor electrodes, data processing modules for processing image data such as pixel values, and modules for analyzing gamma curves, determining excluded values, and dithering pixel values. Further example modules include sensor operation modules configured to operate sensing element(s) in the input sensing region 130 to detect input devices 140.

It should be understood that while many embodiments of the invention are described in the context of a fully functioning apparatus, the mechanisms of the present invention are capable of being distributed as a program product (e.g., software) in a variety of forms. For example, the mechanisms of the present invention may be implemented and distributed as a software program on information bearing media that are readable by electronic processors (e.g., non-transitory computer-readable and/or recordable/writable information bearing media readable by the processing system 110). Additionally, the embodiments of the present invention apply equally regardless of the particular type of medium used to carry out the distribution. Examples of non-transitory, electronically readable media include various discs, memory sticks, memory cards, memory modules, and the like. Electronically readable media may be based on flash, optical, magnetic, holographic, or any other storage technology.

As used in this document, the term "display device" broadly refers to any type of dynamic display capable of displaying a visual interface to a user, and may include any type of light emitting diode (LED), organic LED (OLED), cathode ray tube (CRT), liquid crystal display (LCD), plasma, electroluminescence (EL), or other display technology. Some non-limiting examples of display devices include displays used in smartphones, tablets, laptop computers, desktop computer monitors, televisions, cellular telephones, e-book readers, personal digital assistants (PDAs), and the like. Although the operation of an exemplary display device—an LCD display device—is described below with respect to FIGS. 2-5C, the techniques described herein may be used with any type of display device, such as those described above.

Dithering to Avoid Pixel Value Conversion Errors

Figure 3A:
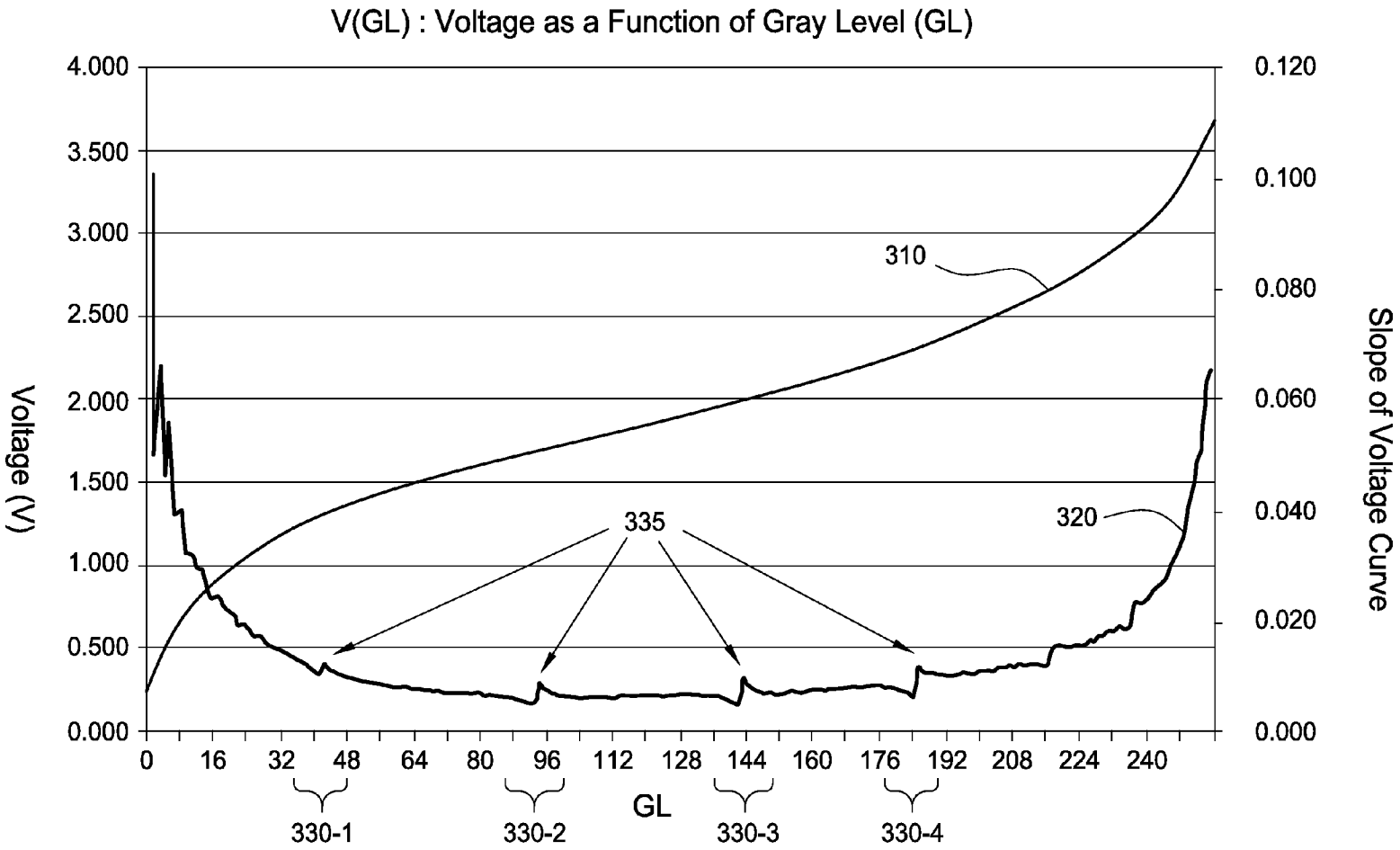
FIGS. 3A and 3B illustrate voltages applied to a sub-pixel in a liquid crystal display (LCD) panel as a function of gray level in accordance with embodiments of the invention.
Figure 3B:
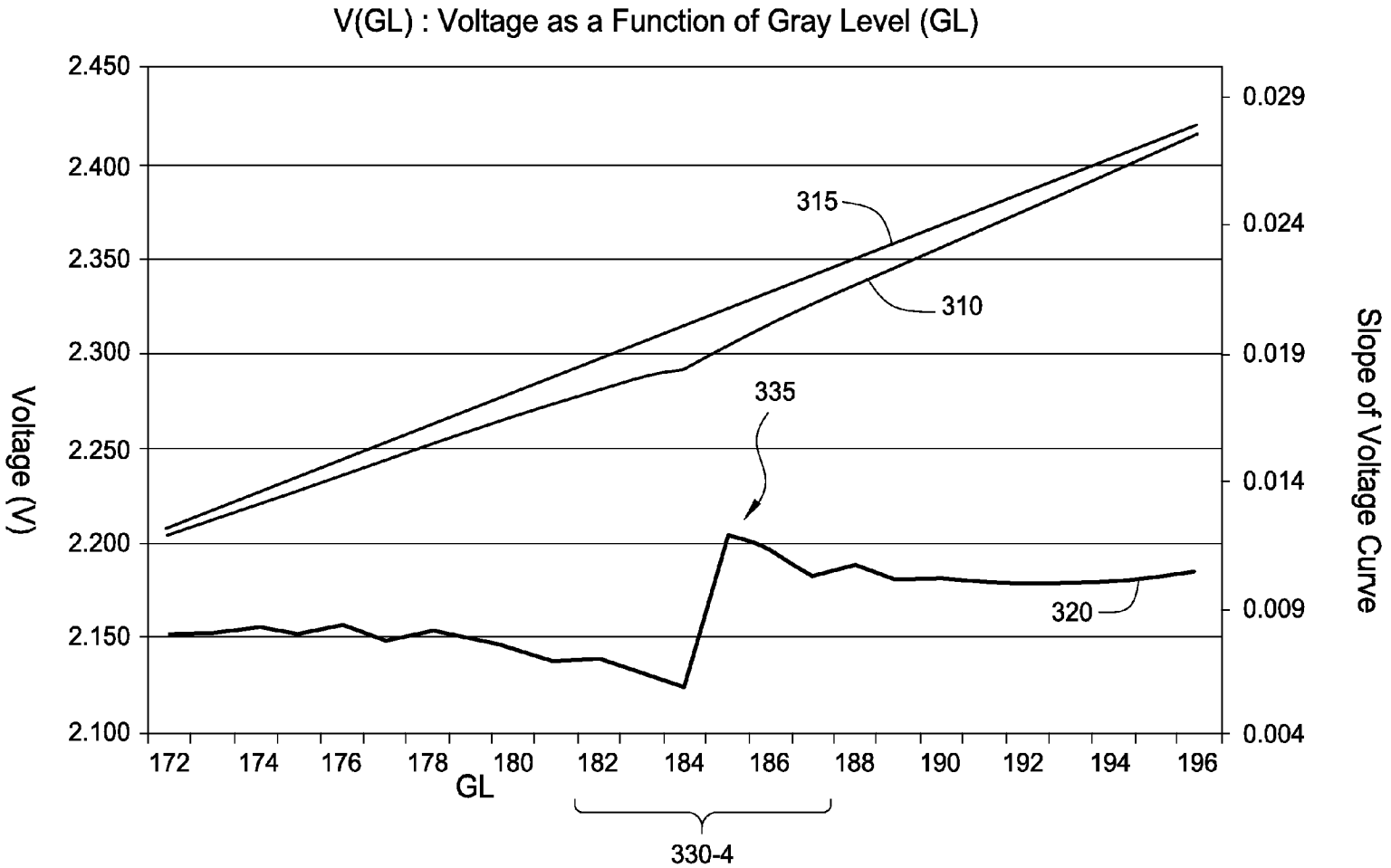

FIGS. 3A and 3B illustrate voltages applied to a sub-pixel in a liquid crystal display (LCD) panel as a function of gray level in accordance with embodiments of the invention. Specifically, pixel value mapping 310 represents voltage as a function of 8-bit gray levels. As shown, the voltage required to reproduce a particular gray level increases as gray level increases. For example, in this particular LCD panel, a gray level of 20 can be reproduced by applying approximately 1 V to a sub-pixel, while a gray level of 144 can be reproduced by applying approximately 2 V to a sub-pixel. Thus, higher voltages are required to reproduce brighter gray levels. In addition, the slope 320 of the pixel value mapping 310 varies as a function of gray level. As shown in FIG. 3A, the slope 320 initially decreases as gray level increases and subsequently remains below approximately 0.02 over the center region of the pixel value mapping 310.

The slope 320 includes several perturbations 335, each of which represents a local region of the underlying pixel value mapping 310 that deviates from a smooth curve. One such deviation, corresponding to gray levels 172 to 196, is shown in further detail in FIG. 3B. In general, a region of the pixel value mapping 310 associated with a perturbation 335 cannot accurately be reproduced using a piecewise linear approximation that includes a moderate and/or practical number of straight lines. For example, approximating the region of the pixel value mapping 310 shown in FIG. 3B using a straight line 315 would cause conversion errors at input pixel values proximate to gray level 184. More specifically, approximating this region with a straight line 315 would map these particular gray levels to voltages that are too high to accurately reproduce the luminance associated with the gray levels. Accordingly, in order to avoid pixel value conversion errors, gray level 184, as well as a number of gray levels proximate to gray level 184, may be added to a set of excluded values 330 (e.g., 330-4). Input pixel values may then be analyzed by processing system 110 to determine whether the pixel values are within the set of excluded values 330. Pixel values that are within the set of excluded values 330 may then be dithered to generate pixel values that are not within the set of excluded values 330.

A variety of techniques may be used to determine which pixel value(s) should be added to the set of excluded values 330. For example, one technique may include analyzing the slope 320 of a pixel value mapping 310 to determine the pixel values at which the pixel value mapping 310 exhibits a perturbation 335, such as any non-uniformity that cannot be accurately represented using a piecewise linear approximation or a similar method of approximation that utilizes a moderate and/or practical number of data points. The processing system 110 may determine, for each of one or more pixel values, whether an approximation is more than a threshold value away from the pixel value mapping 310. For example, with reference to FIG. 3B, the processing system 110 may determine that, at gray level 184, the straight-line approximation is more than 0.01 V higher or lower than the pixel value mapping 310 on which the approximation is based. The processing system 110 may then add gray level 184 to the set of excluded values 330-4. Additionally, the processing system 110 may determine that, at gray levels 183 and 185, the straight-line approximation is more than 0.01 V higher than the pixel value mapping 310. The processing system 110 may then add gray levels 183 and 185 to the set of excluded values 330-4.

Further, the processing system 110 may add one or more pixel values proximate to gray levels 183, 184 and 185 (e.g., gray levels 180, 181, 186 and 187) to the set of excluded values 330-4 in order to buffer for changes to the location of the perturbation 335. Such changes to the location of a perturbation may result from, for example, temperature fluctuations, manufacturing variations, device age, and the like. The number of buffer pixel values added to the set of excluded values may be based on the number of pixel values determined to be more than the threshold value away from a given region of the pixel value mapping 310. For example, the number of buffer pixel values added to the set of excluded values may be a percentage of the number of pixel values determined to be more than the threshold value away from a given region of the pixel value mapping 310. In other embodiments, the number of buffer pixel values added to the set of excluded values 330 for a given region of the pixel value mapping 310 may be a fixed number, such as 1 to 5 pixel values.

Although the above techniques are described as being performed with a piecewise linear approximation of a pixel value mapping 310, excluded values may be determined and processed based on any mathematical or empirical technique of approximating a pixel value mapping 310. Moreover, the techniques described herein may be implemented using any type of general processor, dedicated processor, application-specific integrated circuit (ASIC), etc. that is associated with, or separate from, the processing system 110.

Figure 1:
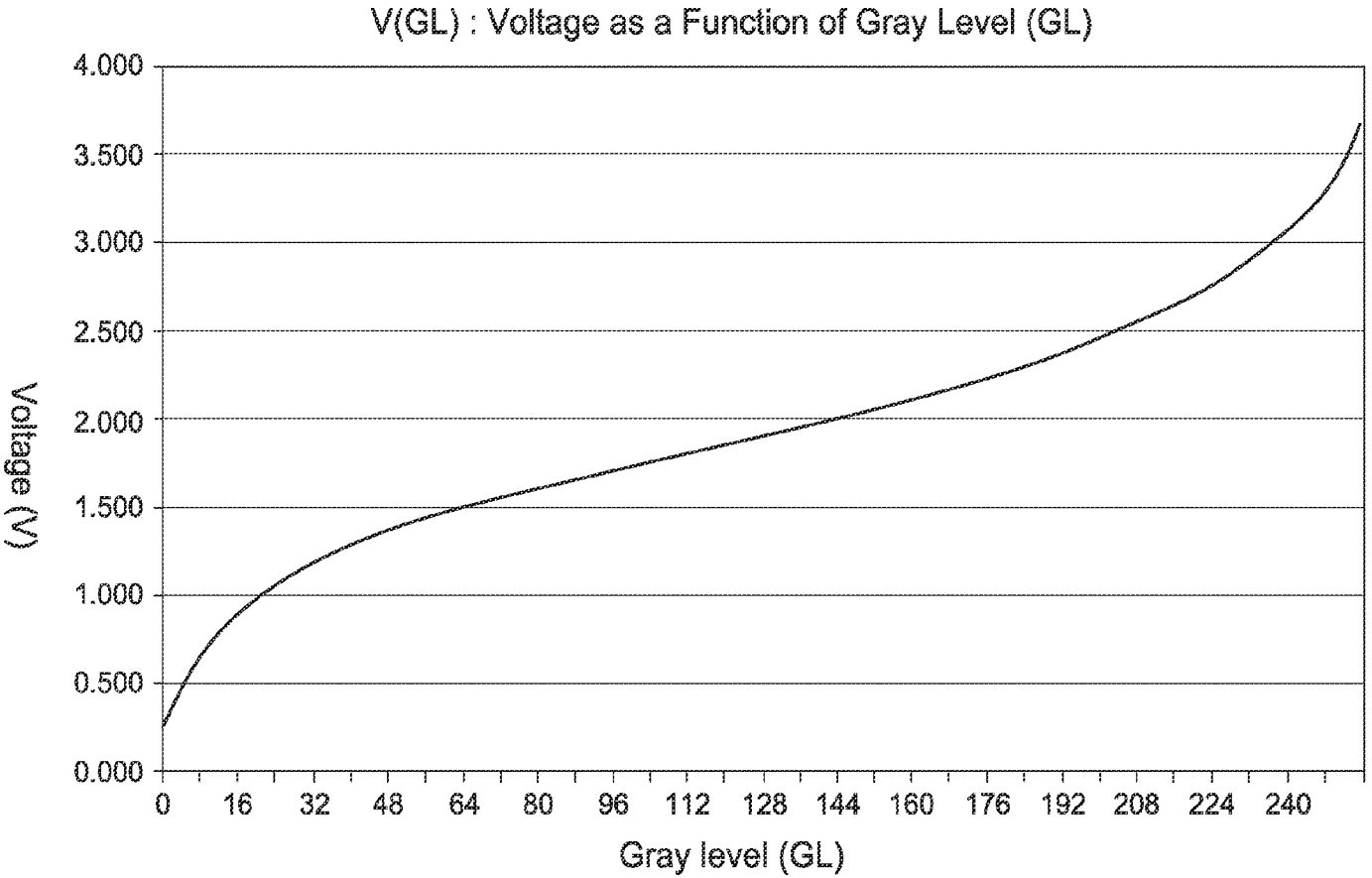
Prior Art FIG. 1
FIG. 1 illustrates a curve that maps incoming color values to the voltages required to accurately reproduce the color values in accordance with embodiments of the invention.
Figure 4:
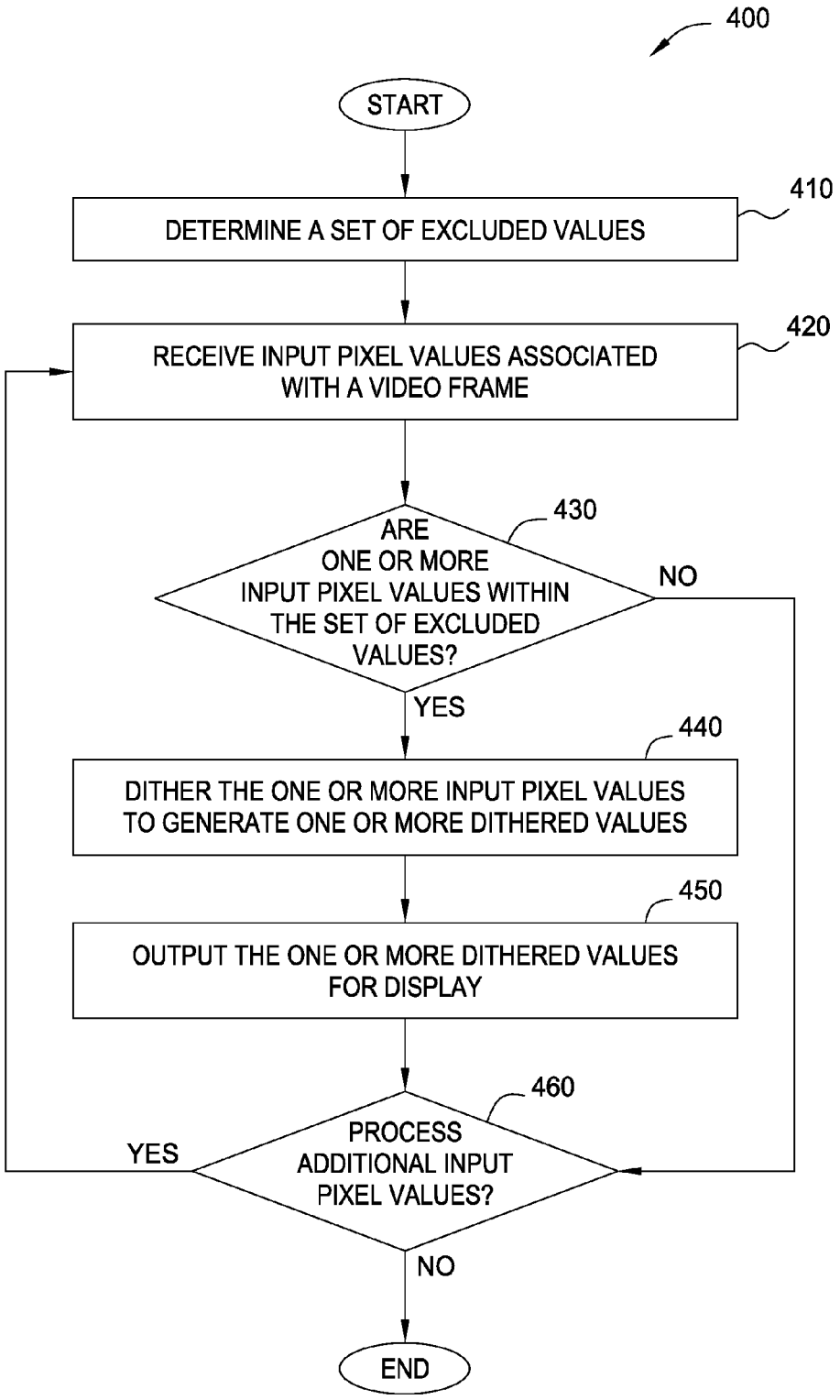
FIG. 4 is a flow diagram of a method for processing an image to avoid pixel value conversion errors in accordance with embodiments of the invention.

FIG. 4 is a flow diagram of a method 400 for processing an image to avoid pixel value conversion errors in accordance with embodiments of the invention. Although the method 400 is described in conjunction with FIGS. 1, 3A and 3B, persons skilled in the art will understand that any system configured to perform the method, in any appropriate order, falls within the scope of the present invention.

The method 400 begins at step 410, where the processing system 110 analyzes a pixel value mapping 310 to determine a set of excluded values 330. As described above, the set of excluded values 330 may be associated with one or more locations on the pixel value mapping 310. For example, with reference to FIG. 3A, a set of excluded values 330 may include one range of values (e.g., 330-1) associated with a single perturbation or multiple ranges of values (e.g., 330-1, 330-2, 330-3, and 330-4), each of which is associated with a different perturbation. In general, a perturbation may include any non-uniformity in the pixel value mapping 310 that cannot be accurately represented using a piecewise linear approximation or other method of approximation that utilizes a moderate and/or practical number of data points. In other embodiments, both the pixel values mapping 310 and the set of excluded values 330 may be provided to the processing system 110 by another unit included in or external to the display device 100.

In one embodiment, the processing system 110 determines a single set of excluded values 330 that are to be used to process the input pixel values associated with all color channels. In other embodiments, a set of excluded values 330 is determined for each color channel. For example, three sets of excluded values 330 may be determined for a display that uses a RGB sub-pixel arrangement such that input pixel values associated with the red color channel are processed in conjunction with a first set of excluded values, input pixel values associated with the green color channel are processed in conjunction with a second set of excluded values, and input pixel values associated with the blue color channel are processed in conjunction with a third set of excluded values. Moreover, if a display were to further include a fourth color channel, such as a yellow color channel (e.g., RGBY), then input pixel values associated with the yellow color channel would be processed in conjunction with a fourth set of excluded values.

Next, at step 420, the processing system 110 receives a plurality of input pixel values associated with one or more video frames. At step 430, the processing system 110 determines whether one or more input pixel values included in the plurality of input pixel values are within the set of excluded values 330. That is, the processing system 110 determines which, if any, of the input pixel values are included in the one or more range of values (e.g., 330-1, 330-2, 330-3, or 330-4) in the set of excluded values 330. If none of the input pixel values are within the set of excluded values 330, then the method 400 proceeds to step 450, where it is determined whether additional input pixel values are to be processed.

Figure 5A:
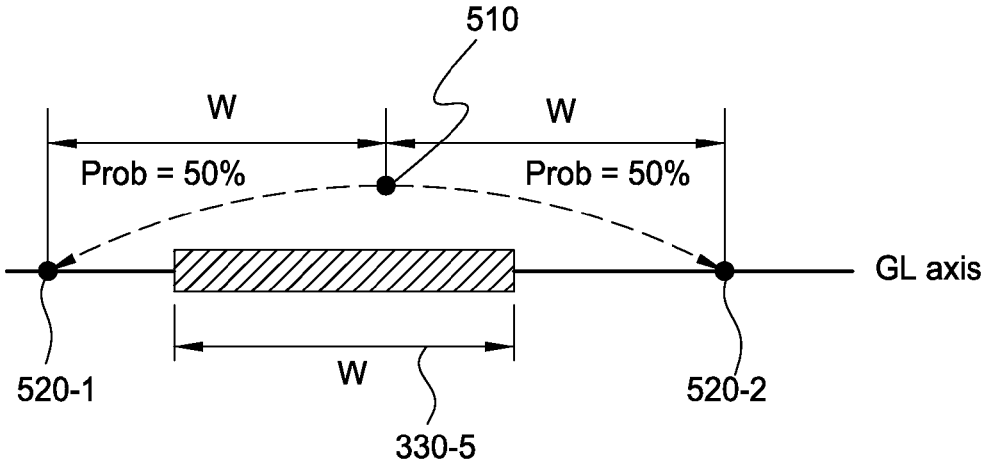
FIGS. 5A-5D illustrate techniques for dithering input pixel values in accordance with embodiments of the invention.
Figure 5B:
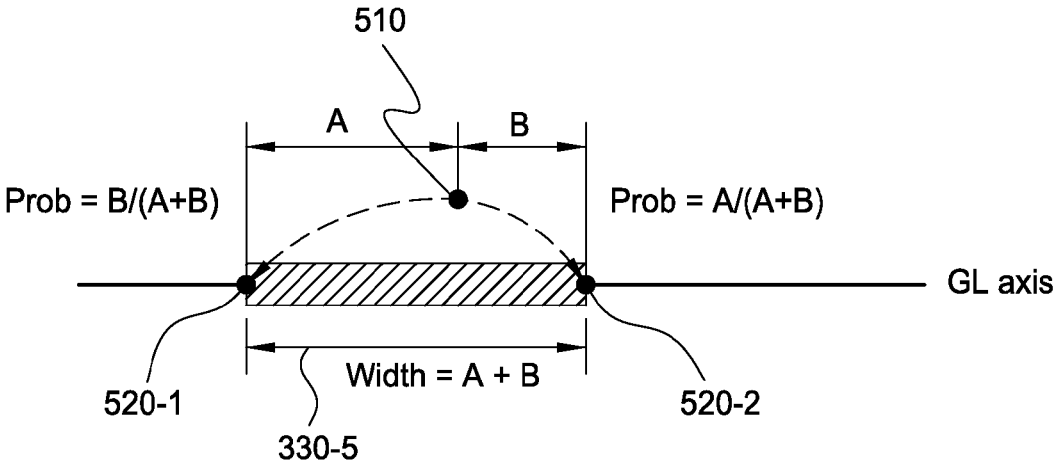
Figure 5C:
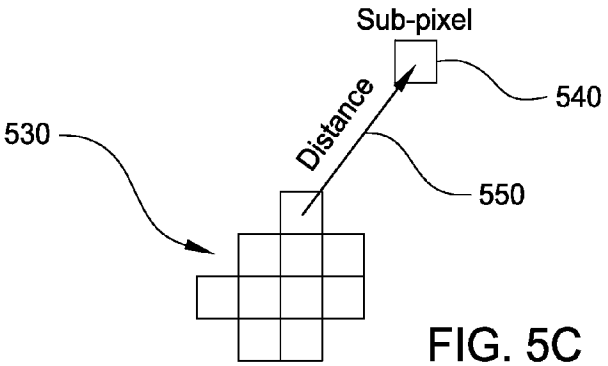

If any of the input pixel values are within the set of excluded values 330, then the method 400 proceeds to step 440, where the input pixel values are dithered to generate one or more dithered values. Dithering may be performed by generating a dither pattern and adding the dither pattern to the input pixel values. In one embodiment, the dither pattern may be a spatio-temporal dither pattern generated based on a frame rate signal, a line rate signal, and/or a pixel rate signal. For example, the dither pattern may be generated based on a vertical sync (VSYNC) signal, a horizontal sync (HSYNC) signal, and/or a pixel clock (PCLK) signal associated with the display device 100. Exemplary techniques for dithering input pixel values are shown in FIGS. 5A-5C, discussed below.

In various embodiments, dithering is applied such that some or all of the resulting dithered values are not within the set of excluded values 330. Additionally, the average pixel value associated with the dithered values generated at step 440 may be substantially the same as the average pixel value associated with the input pixel values from which the dithered values were generated. In one embodiment, dithering of input pixel values at step 440 may include dithering only the input pixel values that are within the set of excluded values 330. In another embodiment, dithering of input pixel values may further include dithering input pixel values that are spatially proximate to the input pixel values that are within the set of excluded values 330. In yet another embodiment, dithering may be applied to substantially all of the input pixel values included in a particular video frame—regardless of whether each input pixel value is within the set of excluded values 330—such that none of the resulting dithered values are within the set of excluded values 330. Dithering substantially all of the input pixel values included in a video frame may be more efficient, since the processing system 110 does not need to determine whether each input pixel value is within the set of excluded values 330 prior to performing dithering.

Dithering may be applied to the input pixel values that are within the set of excluded values 330—as well as to the input pixel values that are spatially proximate to the input pixel values which are within the set of excluded values 330—using a feathering algorithm in order to produce a smooth transition between dithered and non-dithered regions of a video frame. In one embodiment, a feathering algorithm may be applied such that heavier dithering is performed on input pixel values that are within the set of excluded values 330, and the strength of dithering applied to pixels that are proximate to these input pixel values decreases as the distance from these input pixel values increases. Another embodiment for performing dithering based on the distance 550 of a pixel value from one or more input pixel values that are within the set of excluded values 330 is illustrated in FIGS. 5C and 5D, discussed below.

At step 450, the one or more dithered values generated at step 440 are outputted for display. Finally, at step 460, a determination is made as to whether additional input pixel values are to be processed. If additional input pixel values are to be processed, then the method 400 returns to step 410, where additional input pixel values are received. If no additional input pixel values are to be processed, then the method 400 ends.

FIGS. 5A-5D illustrate techniques for dithering input pixel values in accordance with embodiments of the invention. As shown in FIG. 5A, dithering may be applied to a particular input pixel value 510 to generate a dithered value 520 that is outside of the set of excluded values 330. In another technique, shown in FIG. 5B, dithering may be applied to a particular input pixel value 510 to generate a dithered value 520 that is outside, and at either edge of, the set of excluded values 330. In either technique, dithering may be applied such that the resulting dithered value 520 has a similar probability of being less than the set of excluded values 330-5 (e.g., dithered value 520-1) or greater than the set of excluded values 330-5 (e.g., dithered value 520-2). Additionally, in either technique, dithering may be applied such that the probability of the resulting dithered value 520 being greater than or less than the set of excluded values 330-5 depends on the location of the input pixel value 510 in a range of values associated with the set of excluded values 330. For example, if the input pixel value 510 is greater than a median pixel value associated with the set of excluded values 330-5, then the resulting dithered value 520 may have a higher probability of being greater than the set of excluded values 330-5, as shown in FIG. 5B. Conversely, if the input pixel value 510 is less than the median pixel value associated with the set of excluded values 330-5, then the resulting dithered value 520 may have a higher probability of being less than the set of excluded values 330-5.

Figure 5D:
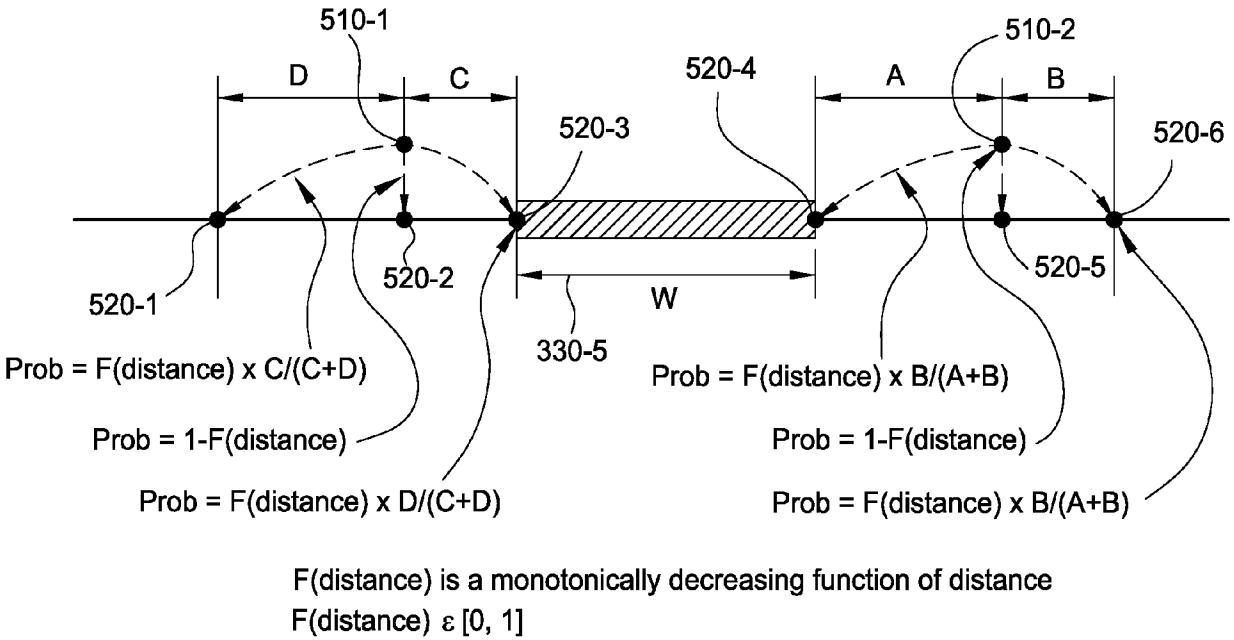

Additionally, as illustrated in FIGS. 5C and 5D, the manner in which dithering is applied to input pixel values 510 (e.g., sub-pixel 540) that are not within a set of excluded values 330 may depend on one or both of (1) the numerical proximity of the input pixel values 510 (e.g., 510-1 and 510-2) to the set of excluded values 330 (e.g., 330-5) and (2) the spatial proximity (e.g., a distance 550) of the input pixel values 510 to input pixel values 510 that are within the set of excluded values 330 (e.g., sub-pixels 530). For example, in order to avoid abrupt transitions between dithered and non-dithered pixels, input pixel values 510 may be dithered such that the amount and/or strength of dithering decreases as numerical distance from the set of excluded values 330 increases. Additionally, the amount and/or strength of dithering applied to input pixel values 510 may decrease as the distance 550 from the input pixel values 510 that are within the set of excluded values 330 (e.g., sub-pixels 530) increases. In one embodiment, the amount and/or strength of dithering may be based on a monotonic function that decreases as distance 550 increases.

Thus, the embodiments and examples set forth herein were presented in order to best explain the present invention and its particular application and to thereby enable those skilled in the art to make and use the invention. However, those skilled in the art will recognize that the foregoing description and examples have been presented for the purposes of illustration and example only. The description as set forth is not intended to be exhaustive or to limit the invention to the precise form disclosed.

The invention claimed is:

1. A method for processing an image, the method comprising:

receiving a plurality of input pixel values associated with a video;

determining that a first portion of pixel values included in the plurality of input pixel values is within a first set of excluded values; and dithering the first portion of pixel values to generate a first plurality of dithered values, wherein each dithered value included in the first plurality of dithered values is not within the first set of excluded values, and a first average pixel value associated with the plurality of input pixel values is substantially similar to a second average pixel value associated with both the first plurality of dithered values and a plurality of pixel values that are spatially proximate to the first plurality of dithered values, wherein the first set of excluded values is associated with perturbations in a pixel value mapping that maps gray level values to values selected from the group consisting of voltage values, electrical current values, and electrical charge values.

2. The method of claim 1, wherein the first set of excluded values comprises one or more ranges of contiguous values.

3. The method of claim 1, wherein dithering of the input pixel values is performed based on at least one of a spatial dither pattern, a temporal dither pattern, and a spatiotemporal dither pattern.

4. The method of claim 1, further comprising dithering a second portion of pixel values included in the plurality of input pixel values to generate the plurality of pixel values that are spatially proximate to the first plurality of dithered values, wherein each pixel value included in the plurality of pixel values that are spatially proximate to the first plurality of dithered values is not within the first set of excluded values.

5. The method of claim 1, further comprising:

determining that a second portion of pixel values included in the plurality of input pixel values is within a second set of excluded values, wherein the first set of excluded values is associated with a first color channel and the second set of excluded values is associated with a second color channel; and dithering the second portion of pixel values to generate a second plurality of dithered values, wherein each dithered value included in the second plurality of dithered values is not within the second set of excluded values.

6. The method of claim 1, further comprising dithering a second portion of pixel values included in the plurality of input pixel values to generate a second plurality of dithered values, wherein each dithered value included in the second plurality of dithered values is not within the second set of excluded values, and the first portion of pixel values and the second portion of pixel values correspond to substantially all of the input pixel values included in the video frame.

7. The method of claim 1, wherein:

receiving the plurality of input pixel values associated with a video frame comprises receiving a plurality of input pixel values associated with a video frame for display on a display unit; and the method further comprises substituting the first portion of pixel values with the first plurality of dithered values for display on the display unit.

8. A processing system for a display device, the processing system comprising:

a display circuit configured to:

receive a plurality of input pixel values associated with a video frame; and determine that a first portion of pixel values included in the plurality of input pixel values is within a first set of excluded values; and a dithering circuit configured to dither the first portion of pixel values to generate a first plurality of dithered values, wherein each dithered value included in the first plurality of dithered values is not within the first set of excluded values, and a first average pixel value associated with the plurality of input pixel values is substantially similar to a second average pixel value associated with both the first plurality of dithered values and a plurality of pixel values that are spatially proximate to the first plurality of dithered values, wherein the first set of excluded values is associated with perturbations in a pixel value mapping that maps gray level values to values selected from the group consisting of voltage values, electrical current values, and electrical charge values.

9. The processing system of claim 8, wherein the first set of excluded values comprises one or more ranges of contiguous values.

10. The processing system of claim 8, wherein dithering of the input pixel values is performed based on at least one of a spatial dither pattern, a temporal dither pattern, and a spatiotemporal dither pattern.

11. The processing system of claim 8, further comprising dithering a second portion of pixel values included in the plurality of input pixel values to generate the plurality of pixel values that are spatially proximate to the first plurality of dithered values, wherein each pixel value included in the plurality of pixel values that are spatially proximate to the first plurality of dithered values is not within the first set of excluded values.

12. The processing system of claim 8, wherein:

the display circuit is further configured to determine that a second portion of pixel values included in the plurality of input pixel values is within a second set of excluded values, wherein the first set of excluded values is associated with a first color channel and the second set of excluded values is associated with a second color channel; and the dithering circuit is further configured to dither the second portion of pixel values to generate a second plurality of dithered values, wherein each dithered value included in the second plurality of dithered values is not within the second set of excluded values.

13. An electronic device, the electronic device comprising:

a display device; and a processing system coupled to the display device, the processing system configured to:

receive a plurality of input pixel values associated with a video frame;

determine that a first portion of pixel values included in the plurality of input pixel values is within a first set of excluded values; and dither the first portion of pixel values to generate a first plurality of dithered values, wherein each dithered value included in the first plurality of dithered values is not within the first set of excluded values, and a first average pixel value associated with the plurality of input pixel values is substantially similar to a second average pixel value associated with both the first plurality of dithered values and a plurality of pixel values that are spatially proximate to the first plurality of dithered values, wherein the first set of excluded values is associated with perturbations in a pixel value mapping that maps gray level values to values selected from the group consisting of voltage values, electrical current values, and electrical charge values.

* * * * *